US006530964B2

(12) United States Patent
Langer et al.

(10) Patent No.: US 6,530,964 B2
(45) **Date of Patent: *Mar. 11, 2003**

(54) CONTINUOUS PROCESS FOR MAKING AN AQUEOUS HYDROCARBON FUEL

(75) Inventors: Deborah A. Langer, Chesterland; David L. Westfall, Lakewood; William E. Skoch, Chardon; John J. Mullay, Mentor, all of OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/731,173

(22) Filed: Dec. 6, 2000

(65) Prior Publication Data

US 2002/0014033 A1 Feb. 7, 2002

Related U.S. Application Data

(63) Continuation-in-part of application No. 09/483,481, filed on Jan. 14, 2000, which is a continuation-in-part of application No. 09/390,925, filed on Sep. 7, 1999, now Pat. No. 6,368,367, which is a continuation-in-part of application No. 09/349,268, filed on Jul. 7, 1999, now Pat. No. 6,368,366.

(51) Int. Cl.[7] ..... C10L 1/32

(52) U.S. Cl. ..... 44/301; 44/302; 44/325; 44/326; 44/629; 44/639

(58) Field of Search ..... 44/301, 302

(56) References Cited

U.S. PATENT DOCUMENTS

| | | | |
|---|---|---|---|
| 2,619,330 A | 11/1952 | Willems | 259/96 |
| 2,858,200 A | 10/1958 | Broughten | 44/57 |
| 3,499,632 A | 3/1970 | Piros | 259/4 |
| 3,756,794 A | 9/1973 | Ford | 44/51 |
| 3,818,876 A | 6/1974 | Voogd | 123/25 R |
| 3,855,103 A | 12/1974 | McLaren et al. | 204/306 |
| 3,876,391 A | 4/1975 | McCoy et al. | 44/51 |
| 4,048,080 A | 9/1977 | Lee et al. | 252/515 A |
| 4,084,940 A | 4/1978 | Lissant | 44/51 |
| 4,146,499 A | 3/1979 | Rosano | 252/186 |
| 4,207,078 A | 6/1980 | Sweeney et al. | 44/68 |
| 4,329,249 A | 5/1982 | Forsberg | 252/34.7 |
| 4,388,893 A | 6/1983 | Apfel | 123/255 |
| 4,433,917 A | 2/1984 | Mendel et al. | 366/132 |

(List continued on next page.)

FOREIGN PATENT DOCUMENTS

| | | | |
|---|---|---|---|
| EP | WO 99/63025 | 12/1999 | 1/32 |
| GB | 2 117 666 A | 10/1983 | |
| WO | WO99/13028 | 3/1999 | |
| WO | WO 99/13029 | 3/1999 | |
| WO | WO 99/13030 | 3/1999 | |
| WO | WO 99/13031 | 3/1999 | |
| WO | WO 00/15740 | 3/2000 | |

OTHER PUBLICATIONS

Kady International; Continuous Flow Dispersion Mills; 2/98; 5 pages (brochure).

Ika, Inc.; Batch Mixers, A Closer Look (www.silverson.com/btchmxr2.htm); Mar. 18, 1999, (printed from internet); 4pages.

Sonic Corp.; Tri–Homo Colloid Mills, catalog TH980; 4 pages (No Date).

Sonic Corp.; Ultrasonic Mixing (brochure); 6 pages (No Date).

Ika; Maschinenbau Dispersing (brochure); 40 pages.

*Primary Examiner*—Ellen M. McAvoy
(74) *Attorney, Agent, or Firm*—Teresan W. Gilbert; Michael F. Esposito; Samuel B. Laferty

(57) ABSTRACT

An aqueous hydrocarbon fuel is produced by a continuous process. Further, the continuous process employs at least two emulsification devices, in series, to produce an aqueous hydrocarbon fuel containing aqueous droplets having a mean diameter of less than 1.0 microns.

25 Claims, 1 Drawing Sheet

Figure 1:
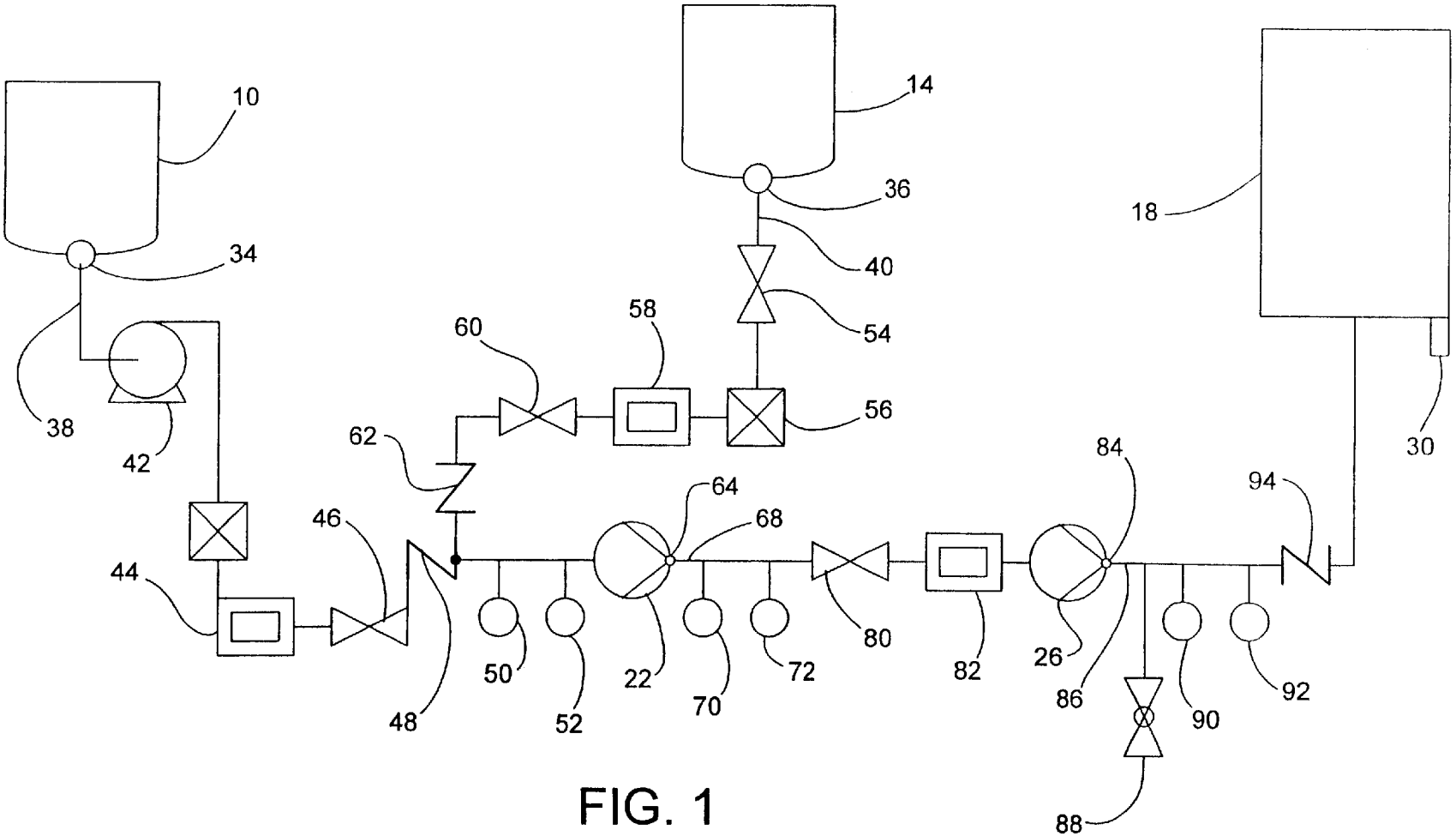

U.S. PATENT DOCUMENTS 4,438,731 A 3/1984 Maggio ..... 123/25 N
4,447,348 A 5/1984 Forsberg ..... 252/75
4,452,712 A 6/1984 Laemmle ..... 252/493
4,482,356 A 11/1984 Hanlon ..... 44/57
4,561,861 A 12/1985 Davis et al. ..... 44/51
4,585,461 A 4/1986 Gorman ..... 44/53
4,613,341 A 9/1986 Zaweski et al. ..... 44/51
4,621,927 A 11/1986 Hiroi ..... 366/132
4,697,929 A 10/1987 Muller ..... 366/97
4,708,753 A 11/1987 Forsberg ..... 149/2
4,776,977 A 10/1988 Taylor ..... 252/314
4,892,562 A 1/1990 Bowers et al. ..... 44/67
4,908,154 A 3/1990 Cook et al. ..... 252/314
4,916,631 A 4/1990 Crain et al. ..... 364/502
4,938,606 A 7/1990 Kunz ..... 366/134
4,953,097 A 8/1990 Crain et al. ..... 364/502
4,983,319 A 1/1991 Gregoli et al. ..... 252/314
4,986,858 A 1/1991 Oliver et al. ..... 149/109.6
5,000,757 A 3/1991 Puttock et al. ..... 44/301
5,104,621 A 4/1992 Pfost et al. ..... 422/67
5,279,626 A 1/1994 Cunningham et al. ..... 44/331
5,352,377 A 10/1994 Blain et al. ..... 252/515 R
5,389,111 A 2/1995 Nikanjam et al. ..... 44/300
5,389,112 A 2/1995 Nikanjam et al. ..... 44/300
5,399,293 A 3/1995 Nunez et al. ..... 252/314
5,404,841 A 4/1995 Valentine ..... 123/25 E
5,411,558 A 5/1995 Taniguchi et al. ..... 44/301
5,445,656 A 8/1995 Marelli ..... 44/301
5,454,964 A 10/1995 Blackborow et al. ..... 252/56 D
5,478,365 A 12/1995 Nikanjam et al. ..... 44/280
5,501,714 A 3/1996 Valentine et al. ..... 44/358
5,503,772 A 4/1996 Rivas et al. ..... 252/314
5,544,856 A 8/1996 King et al. ..... 251/129.08
5,556,574 A 9/1996 Rivas et al. ..... 252/311.5
5,563,189 A 10/1996 Hosokawa et al. ..... 523/322
5,584,326 A 12/1996 Galli ..... 141/83
5,622,920 A 4/1997 Rivas et al. ..... 807/232
5,624,999 A 4/1997 Lombardi et al. ..... 525/52
5,632,596 A 5/1997 Ross ..... 415/83
5,643,528 A 7/1997 Le Gras ..... 266/88
5,669,938 A 9/1997 Schwab ..... 44/301
5,682,842 A 11/1997 Coleman et al. ..... 123/25 C
5,706,896 A 1/1998 Tubel et al. ..... 166/313
5,743,922 A 4/1998 Peter-Hoblyn et al. ..... 44/301
5,746,783 A 5/1998 Compere et al. ..... 44/301
5,792,223 A 8/1998 Rivas et al. ..... 44/302
5,851,245 A 12/1998 Moriyama et al. ..... 44/301
5,862,315 A 1/1999 Glaser et al. ..... 395/182.09
5,863,301 A 1/1999 Grosso et al. ..... 44/301
5,868,201 A 2/1999 Bussear et al. ..... 166/53
5,873,916 A 2/1999 Cemenska et al. ..... 44/301
5,879,079 A 3/1999 Hohmann et al. ..... 366/151.1
5,879,419 A 3/1999 Moriyama et al. ..... 44/301
5,895,565 A 4/1999 Steininger et al. ..... 210/85
5,896,292 A 4/1999 Hosaka et al. ..... 364/468.15
6,068,670 A * 5/2000 Haupais et al. ..... 44/301

* cited by examiner

CONTINUOUS PROCESS FOR MAKING AN AQUEOUS HYDROCARBON FUEL

This is a continuation in part of U.S. application Ser. No. 09/483,481 filed Jan. 14, 2000 now allowed; which is a continuation in part of U.S. application Ser. No. 09/390,925 filed Sep. 7, 1999, now U.S. Pat. No. 6,368,367; which is a continuation in part of U.S. application Ser. No. 09/349,268 filed Jul. 7, 1999 now U.S. Pat. No. 6,368,366. All of the disclosures in the prior applications are incorporated herein by reference in their entirety.

TECHNICAL FIELD

The invention relates to a process for making aqueous hydrocarbon fuel compositions from a continuous process. More particularly, the invention relates to a continuous process for making an aqueous hydrocarbon fuel such as a diesel fuel or gasoline.

BACKGROUND OF THE INVENTION

Internal combustion engines, especially diesel engines, using water mixed with fuel in the combustion chamber can produce lower NOx, hydrocarbon and particulate emissions per unit of power output. Nitrogen oxides are an environmental issue because they contribute to smog and pollution. Governmental regulation and environmental concerns have driven the need to reduce NOx emissions from engines.

Diesel fueled engines produce NOx due to the relatively high flame temperatures reached during combustion. The reduction of NOx production includes the use of catalytic converters, using "clean" fuels, recirculation of exhaust and engine timing changes. These methods are typically expensive or complicated to be commercially used.

Water is inert toward combustion, but lowers the peak combustion temperature resulting in reduced particulates and NOx formation. When water is added to the fuel it forms an emulsion and these emulsions are generally unstable. Stable water-in-fuel emulsions of small particle size are difficult to reach and maintain. It would be advantageous to make a stable water-in-fuel emulsion that can be made continuously and stable in storage.

It would be advantageous to produce stable water-in-fuel emulsions by a continuous process because of increased throughput, increased shear efficiency, and cost effectiveness over a batch blending process. Applicant has discovered a continuous process to make stable water-in-fuel emulsions of small particle size.

The term "NOx" is used herein to refer to any of the nitrogen oxides, NO, $NO_2$, $N_2O$, or mixtures of two or more thereof. The terms "aqueous hydrocarbon fuel emulsion" and "water fuel emulsion" are interchangeable. The terms "aqueous hydrocarbon fuel" and "water fuel blend" are interchangeable.

SUMMARY OF THE INVENTION

The invention relates to a continuous process for making an aqueous hydrocarbon fuel, comprising: (1) mixing liquid hydrocarbon fuel and an emulsifier to form a hydrocarbon fuel/additive mixture; (2) emulsifying said hydrocarbon fuel/additive mixture with water under shear conditions to form an aqueous hydrocarbon fuel emulsion, wherein said emulsification is accomplished by at least two emulsifiers in series. The aqueous hydrocarbon fuel emulsion includes a discontinuous aqueous phase in a continuous fuel phase. The discontinuous aqueous phase comprises aqueous droplets having a mean diameter of 1.0 micron by the time the aqueous hydrocarbon fuel emulsion has been processed through the second emulsifier.

The water hydrocarbon fuel emulsion is comprised of water, fuel such as diesel, gasoline or the like and an emulsifier. The emulsifier includes but is not limited to: (i) at least one fuel-soluble product made by reacting at least one hydrocarbyl-substituted carboxylic acid acylating agent with ammonia or an amine, the hydrocarbyl substituent of said acylating agent having about 50 to about 500 carbon atoms; (ii) at least one of an ionic or a nonionic compound having a hydrophilic-lipophilic balance (HLB) of about 1 to about 40; (iii) a mixture of (i) and (ii); or (iv) a water-soluble compound selected from the group consisting of amine salts, ammonium salts, azide compounds, nitrate esters, nitramine, nitro compounds, alkali metal salts, alkaline earth metal salts, in combination with (i), (ii) or (iii).

The water hydrocarbon fuel emulsion optionally includes additives. The additives include but are not limited to a cetane improver(s), an organic solvent(s), an antifreeze agent(s), surfactant(s), other additives known for their use in fuels and combinations thereof.

This invention further provides for an apparatus for continuously making an aqueous hydrocarbon fuel, comprising: at least two emulsifiers in series; a tank containing a hydrocarbon fuel/additive mixture or separate tanks for the hydrocarbon fuel, emulsifier, additives, water, antifreeze or combinations thereof; pump(s) and conduit(s) for transferring the hydrocarbon fuel, additive, and/or emulsifier from the tanks to a first emulsification device; a conduit for transferring water from a water source to the first emulsification device; a conduit for transferring the aqueous hydrocarbon fuel emulsion from the first emulsification device to the second emulsification device; a conduit for transferring the aqueous hydrocarbon fuel emulsion from a second emulsification device to a fuel storage tank; a conduit for dispensing the aqueous hydrocarbon fuel emulsion from the fuel storage tank; a programmable logic controller for controlling: (i) the transfer of the components from the tanks to the first emulsification device (ii) the transfer of water from the water source to the first emulsification device; (iii) the emulsification of the hydrocarbon fuel/additive mixture and the water in the first emulsification device; (iv) the transfer of the aqueous hydrocarbon fuel emulsion from the first emulsification device to the second emulsification device; (v) the further emulsification of the hydrocarbon fuel emulsion in the second emulsification device, (vi) the transfer of the aqueous hydrocarbon fuel emulsions from the second emulsification device to a fuel storage tank; and (vii) a computer for controlling the programmable logic controller.

In one embodiment, the apparatus for the continuous process is in the form of a containerized equipment unit that operates automatically. This unit can be programmed and monitored locally at the site of its installation, or it can be programmed and monitored from a location remote from the site of its installation. The water fuel blend is dispensed to end users at the installation site. This provides a way to make the aqueous hydrocarbon fuel emulsions prepared in accordance with the invention available to end users in wide distribution networks.

DESCRIPTION OF THE PREFERRED EMBODIMENTS

As used herein, the terms "hydrocarbyl substituent," "hydrocarbyl group," "hydrocarbyl-substituted," "hydrocarbon group," and the like, are used to refer to a group having one or more carbon atoms directly attached to the remainder of a molecule and having a hydrocarbon or predominantly hydrocarbon character. Examples include:

(1) purely hydrocarbon groups, that is, aliphatic (e.g., alkyl, alkenyl or alkylene), and alicyclic (e.g., cycloalkyl, cycloalkenyl) groups, aromatic groups, and aromatic-, aliphatic-, and alicyclic-substituted aromatic groups, as well as cyclic groups wherein the ring is completed through another portion of the molecule (e.g., two substituents together forming an alicyclic group);

(2) substituted hydrocarbon groups, that is, hydrocarbon groups containing non-hydrocarbon groups which, in the context of this invention, do not alter the predominantly hydrocarbon nature of the group (e.g., halo, hydroxy, alkoxy, mercapto, alkylmercapto, nitro, nitroso, and sulfoxy);

(3) hetero-substituted hydrocarbon groups, that is, hydrocarbon groups containing substituents which, while having a predominantly hydrocarbon character, in the context of this invention, contain other than carbon in a ring or chain otherwise composed of carbon atoms. Heteroatoms include sulfur, oxygen and nitrogen. In general, no more than two, and in one embodiment no more than one, non-hydrocarbon substituent is present for every ten carbon atoms in the hydrocarbon group.

The term "lower" when used in conjunction with terms such as alkyl, alkenyl, and alkoxy, is intended to describe such groups that contain a total of up to 7 carbon atoms.

The term "water-soluble" refers to materials that are soluble in water to the extent of at least one gram per 100 milliliters of water at 25° C.

The term "fuel-soluble" refers to materials that are soluble in the fuel to the extent of at least one gram per 100 milliliters of fuel at 25° C.

The term "water fuel emulsion" is interchangeable with aqueous hydrocarbon fuel/additive emulsion.

The term "water fuel blend" is interchangeable with aqueous hydrocarbon fuel.

The term "fuel-chemical additives mixtures" is interchangeable with hydrocarbon fuel/additive mixtures.

The Continuous Process

The invention provides for a continuous process for making an aqueous hydrocarbon fuel by forming a stable emulsion in which the water is suspended in a continuous phase of fuel wherein the water droplets have a mean diameter of 1.0 microns or less. The droplet size are in volume. The invention provides for in another embodiment an apparatus for continuously making the aqueous hydrocarbon fuel. The continuous process apparatus comprises at least two emulsification mixers in series, a tank(s) containing the hydrocarbon fuel, emulsifier, additives and combinations thereof, a tank containing the water, a product tank, pumps, conduits for transferring the fluids, and a programmable logic controller so that the process may be automatic.

In the practice of the present invention the aqueous hydrocarbon fuel is made by a continuous process capable of monitoring and adjusting the flow rates of the fuel, emulsifier, additives and/or water to form a stable emulsion with the desired water droplet size. The process and apparatus described below depict one embodiment of the continuous process. Referring to FIG. 1, the apparatus includes a fuel additive tank (10), a water feed tank (14), a product tank (18), a first emulsification device (22), a second emulsification device (26), and a fuel dispenser 30 (30). Initially the hydrocarbon fuel and the emulsifier are mixed in the fuel additives tank (10) to form a homogeneous hydrocarbon fuel/additives mixture. In another embodiment the feeds of the hydrocarbon fuel, the emulsifier and the additives are added to the water tank (10) by discreet feeds, or in the alternative combinations of the discreet feeds, to form a homogeneous hydrocarbon fuel/additive mixture. In another embodiment the emulsifier, the fuel and the additives are mixed dynamically and fed continuously and then processed with the water stream to form an aqueous hydrocarbon fuel emulsion.

The hydrocarbon fuel/additive mixture contains about 50% to about 99% by weight, in another embodiment about 85% to about 98% by weight, and in another embodiment about 95% to about 98% by weight hydrocarbon fuel, and it further contains about 0.05% to about 25%, in another embodiment about 2% to about 15%, and in another embodiment about 2% to about 5% by weight of the emulsifier.

Optionally, additives may be added to the emulsifier, the fuel, the water or combinations thereof. The additives include but are not limited to cetane improvers, organic solvents, antifreeze agents, surfactants, other additives known for their use in fuel and the like. The additives are added to the emulsifier, hydrocarbon fuel or the water prior to and in the alternative at the first emulsification device dependent upon the solubility of the additive. However, it is preferable to add the additives to the emulsifier to form an additive emulsifier mixture. The additives are generally in the range of about 1% to about 40% by weight, in another embodiment about 5% to about 30% by weight, and in another embodiment about 7% to about 25% by weight of the additive emulsifier mixture.

The hydrocarbon fuel/additives mixture stream exits the hydrocarbon fuel tank outlet (34) and flows through conduit (38) generally at a rate of about 0.5 gallon to 1000 gallons per minute, and in another embodiment about 10 gallons to about 600 gallons per minute into the first emulsification device (22) through conduit (38). The ratio of hydrocarbon fuel/additives mixture to water is in the range of about 50 to about 99 to about 50 to about 1, in another embodiment about 85 to about 95 to about 15 to about 5, in another embodiment about 75 to about 85 to about 25 to about 15, and in another embodiment about 70 to about 75 to about 30 to about 25.

The water, which can optionally include but is not limited to antifreeze, ammonium nitrate or mixtures thereof, flows out of water feed tank outlet (36) through conduit (46) into the first emulsification device (22) at a rate of 0.5 gallon to about 1000 gallons a minute, and in another embodiment about 10 gallons to about 600 gallons per minute. Ammonium nitrate is generally added to the water mixture as aqueous solution. In one embodiment the water, the alcohol and/or the ammonium nitrate are mixed dynamically and fed continuously to the fuel additives stream. In another embodiment the water, antifreeze, ammonium nitrate or mixtures thereof flow out of separate tanks and/or combinations thereof into or mixed prior to the first emulsification device (22). In one embodiment the water, water alcohol, water-ammonium-nitrate, or water-alcohol ammonium nitrate mixture meets the hydrocarbon fuel additives mixture immediately prior to or in the first emulsification device (22).

The hydrocarbon fuel additive stream during startup and shutdown is such that the ratio of water to hydrocarbon fuel additive is never greater than the steady state condition.

In one embodiment arranged in series between the fuel additive tank (10) and the first emulsification device (22) are a feed pump (42), a flow meter (44), a shut-off valve (46), a check valve (48), a temperature gauge (50), and a pressure gauge (52). In one embodiment arranged in series between the water tank (14) and the first emulsification device are a valve (54), an aqueous feed pump (56), a flow meter (58), a shut-off valve (60), and a check valve (62).

The first shearing is generally in the first emulsification device (22) and processed generally under ambient conditions. The first emulsification occurs generally with a pressure drop in the range of about 0 psi to about 10 psi, in another embodiment in the range of about 10 psi to about 80 psi, and in another embodiment in the range of about 15 psi to about 30 psi.

The first emulsification device (22) is used to thoroughly mix the components to produce a more uniform dispersion of the water droplets in the fuel, as well as to impart some of the shearing needed to reduce the water droplet size so that the second emulsification device provides the desired water droplet size. This step distributes the concentration of the components more uniformly through the mixture. The first emulsification device (22) is also used to insure that the additives have good contact with the aqueous components before being fed to the second emulsification mixer (26). The emulsion is mixed in the first emulsification device (22) until an emulsion has proceeded to having a mean droplet particle size of greater than 1 micron, in another embodiment about 1 micron to about 1000 microns, and in another embodiment about 50 microns to about 100 microns, and in another embodiment about 1 micron to about 20 microns.

The first emulsification occurs by any method used in the industry including but not limited to mixing, mechanical mixer agitation, static mixers, shear mixers, sonic mixers, high-pressure homogenizers, and the like. Examples of the first emulsification devices include but are not limited to an Aquashear, pipeline static mixers and the like. The Aquashear is a low-pressure hydraulic shear device. The material is forced through two facing plates with drilled holes into the mixing chamber. The two plates cause counter rotational flow and allow the material to mix. The Aquashear mixers are available from Flow Process Technologies Inc.

The emulsion then flows out of the first emulsification device outlet (64) through conduit (68) directly to the second emulsification device (26). There is no intermediate holding tank between the first emulsification device (22) and the second emulsification device (26). Arranged in series along conduit (68) between the first emulsification device (22) and the second emulsification device (26) is a temperature gauge (70), a pressure gauge (72), a valve (80), and a flow meter (82). The emulsion stream flows directly from the first emulsification device (22) to the second emulsification device (26). There is no holding tank between the first emulsification device (22) and the second emulsification device (26). The emulsion is not aged between the first emulsification device (22) and the second emulsification device (26). Generally the time the emulsion flows from the first emulsification device (22) to the second emulsification device (26) in less than 5 minutes, in another embodiment less than 4 minutes, in another embodiment less than 3 minutes, in another embodiment less than 2 minutes, in another embodiment less than 1 minute, and in another embodiment less than 30 seconds.

The second emulsification is a high-shear device and occurs under ambient conditions. The second emulsification device (26) results in emulsion having a mean particle droplet size in the range of about 0.01 micron to about 1 micron, in one embodiment in the range of about 0.1 micron to about 0.95 microns, in one embodiment in the range of about 0.1 microns to about 0.8 microns and in one embodiment in the range of about 0.1 microns to about 0.7 microns. A critical feature of the invention is that the water phase of the aqueous fuel product is comprised of water droplets having a mean diameter of one micron or less. Thus the second emulsification is conducted under sufficient conditions to provide such a mean droplet particle size.

High-shear devices that may be used include but are not limited to IKA Work Dispax, the IK shear mixers include the DR3-6 with three stages of rotor/stator combinations. The tip speed of the rotor/stator generators may be varied by a variable frequency drive that controls the motor. The Silverson mixer is a two-stage mixer, which incorporates a rotor/stator design. The mixer has high-volume pumping characteristics similar to centrifugal pump. Inline shear mixers by Silverson Corporation (a rotor-stator emulsification approach); Jet Mixers (venturi-style/cavitation shear mixers), Ultrasonolator made by the Sonic Corp. (ultrasonic emulsification approach), Microfluidizer shear mixers available by Microfluidics Inc. (high-pressure homogenization shear mixers), ultrasonic mixers, and any other available high-shear mixer.

There can be one or more emulsification devices used in series and used for final shearing size. These emulsification devices have to have the ability to reduce the mean particles size of the water droplet to less than one micron. By using at least two emulsification devices in series, more shear is directed to the emulsion. This decreases the overall particle size and increases emulsion stability. The mixers described for the first emulsification device and for the second emulsification device are generally interchangeable, however, the second emulsification device needs to be a high shear device.

The emulsion then flows out of the second emulsification device outlet (84) through conduit (86) to the product tank (18). Arranged in series along a conduit (86) are a sampling valve (88), a temperature gauge (90), a pressure gauge (92), and a check valve (94).

The continuous process is generally processed under ambient conditions. The continuous process is generally done at atmospheric pressure. The continuous process generally occurs at ambient temperature. In one embodiment the temperature is in the range of about ambient temperature to about 212° F., and in another embodiment in the range of about 40° F. to about 150° F.

A programmable logic controller (plc), not shown in FIG. 1, is provided for governing the continuous flow of the aqueous hydrocarbon fuel additive mixture, the water, and aqueous hydrocarbon fuel emulsion thereby controlling the flow rates and mixing ratio in accordance with the prescribed blending rates. The plc stores component percentages input by the operator. The plc then uses these percentages to define volumes/flow of each component required. Continuous flow sequence is programmed into the plc. The plc electronically monitors all level switches, valve positions and fluid meters.

EXAMPLE 1

This example is illustrative of making the water-blended fuel product by a continuous process. A mixture having the following composition was prepared by (using) the components together.

23.8% weight % 2-ethylhexyl nitrate;

7.1% weight % hexadecyl succinnate-aminoester/salt surfactant;

9.3% weight % ammonium nitrate 54% weight in water;

40% weight % of 2000 Mn PIB succinnate-aminoester-salt salt surfactant;

19.8% weight % of 1000 Mn PIB succinate-imide/amide surfactant.

About 2.5% weight of the above additive emulsifier mixture is added to about 97.5% weight of BP Low Sulfur Diesel Supreme fuel and blended continuously to produce the hydrocarbon fuel mixture. The hydrocarbon fuel mixture, at a flow rate of 9.92 gallons per minute, was mixed with water that had a flow rate of about 2.8 gallons per minute at room temperature. The water-fuel was then pumped through a conduit to the first shear mixer. The first shear mixer was an Aquashear Mixer with approximately 7 psig pressure drop at about 12-gallon flow rate. The resultant emulsion was then pumped through a conduit to a second shear mixer, a 12 GPM IKA Works Dispax mixer with three superfine mixing elements operating at about 8000 rpm (revolutions per minute).

The processing streams were introduced as close to the entry portal of the first shear mixer as possible. The product was pumped through a conduit from the second shear mixer into the product tank. The particle size of the resulting emulsion made by the continuous process with an identical formulation made via a batch process is shown below:

Particle Size Results of Continuously Blended Water Fuel Samples

| Sample Identity | % Vol < 1.0 μm | 95% less than | 85% less than | Mean | Mode |
|---|---|---|---|---|---|
| 1 | 93.1 | 1.653 μm | 0.534 μm | 0.516 μm | 0.393 μm |
| 2 | 82.6 | 2.197 μm | 1.241 μm | 0.699 μm | 0.432 μm |
| 3 | 87.3 | 1.990 μm | 0.622 μm | 0.623 μm | 0.423 μm |
| 4 | 84.5 | 2.123 μm | 0.777 μm | 0.683 μm | 0.432 μm |

Particle Size Results of Batch Blended Water Fuel Samples

| Sample Identity | % Vol < 1.0 μm | 95% less than | 85% less than | Mean | Mode |
|---|---|---|---|---|---|
| A | N/A | 5.359 μm | 0.619 μm | 1.077 μm | 0.393 μm |
| B | 92.7 | 3.469 μm | 0.502 μm | 0.680 μm | 0.393 μm |
| C | 74.5 | 5.595 μm | 2.849 μm | 1.343 μm | 0.358 μm |
| D | 92.0 | 3.157 μm | 0.478 μm | 0.655 μm | 0.358 μm |
| E | 90.6 | 4.285 μm | 0.539 μm | 0.752 μm | 0.393 μm |
| F | 84.6 | 6.163 μm | 0.857 μm | 1.225 μm | 0.393 μm |

The final product is a water-blended fuel emulsion with the mean particle size typically less than that made by batch blended process. The example showed that a continuous process unexpectedly consistently produced high quality results compared to the batch-produced water fuel as measured by particle size analysis and stability of the final emulsion.

The water-blended fuel product produced by the continuous process involves less processing time than by a batch process. Furthermore, in a batch process there is generally a minimum of five statistical tank turnovers needed based on the fluid dynamics of batch shearing process to produce a water-blended fuel product. The number of statistical tank turnovers is directly related to throughput of the blending unit. Thus, a continuous process to make the same water-blended fuel product is an improvement over a batch process because of the increased throughput and efficiency.

The Engines

The engines that may be operated in accordance with the invention include all compression-ignition (internal combustion) engines for both mobile (including marine) and stationary power plants including but not limited to diesel, gasoline, and the like. The engines that can be used include but are not limited to those used in automobiles, trucks such as all classes of truck, buses such as urban buses, locomotives, heavy duty diesel engines, stationary engines (how define) and the like. Included are on- and off-highway engines, including new engines as well as in-use engines. These include diesel engines of the two-stroke-per-cycle and four-stroke-per-cycle types.

The Water Fuel Emulsions

In one embodiment, the water fuel emulsions are comprised of: a continuous fuel phase; discontinuous water or aqueous phase; and an emulsifying amount of an emulsifier. The emulsions may contain other additives that include but are not limited to cetane improvers, organic solvents, antifreeze agents, and the like. These emulsions may be prepared by the steps of (1) mixing the fuel, emulsifier and other desired additives using standard mixing techniques to form a fuel-chemical additives mixture (hydrocarbon fuel/additives mixture); and (2) mixing the fuel-chemical additives mixture with water (and optionally an antifreeze agent) under emulsification conditions to form the desired aqueous hydrocarbon fuel emulsion. Alternatively, the water-soluble compounds (iii) used in the emulsifier can be mixed with the water prior to the high-shear mixing.

The water or aqueous phase of the aqueous hydrocarbon fuel emulsion is comprised of droplets having a mean diameter of 1.0 micron or less. Thus, the emulsification generally occurs by shear mixing and is conducted under sufficient conditions to provide such a droplet size.

The Liquid Hydrocarbon Fuel

The liquid hydrocarbon fuel comprises hydrocarbonaceous petroleum distillate fuel, non-hydrocarbonaceous water, oils, liquid fuels derived from vegetables, liquid fuels derived from mineral and mixtures thereof. The liquid hydrocarbon fuel may be any and all hydrocarbonaceous petroleum distillate fuels including not limited to motor gasoline as defined by ASTM Specification D439 or diesel fuel or fuel oil as defined by ASTM Specification D396 or the like (kerosene, naptha, aliphatics and paraffinics). The liquid hydrocarbon fuels comprising non-hydrocarbonaceous materials include but are not limited to alcohols such as methanol, ethanol and the like, ethers such as diethyl ether, methyl ethyl ether and the like, organo-nitro compounds and the like; liquid fuels derived from vegetable or mineral sources such as corn, alfalfa, shale, coal and the like. The liquid hydrocarbon fuels also include mixtures of one or more hydrocarbonaceous fuels and one or more non-hydrocarbonaceous materials. Examples of such mixtures are combinations of gasoline and ethanol and of diesel fuel and ether.

In one embodiment, the liquid hydrocarbon fuel is any gasoline. Generally, gasoline is a mixture of hydrocarbons having an ASTM distillation range from about 60° C. at the 10% distillation point to about 205° C. at the 90% distillation point. In one embodiment, the gasoline is a chlorine-free or low-chlorine gasoline characterized by a chlorine content of no more than about 10 ppm.

In one embodiment, the liquid hydrocarbon fuel is any diesel fuel. Diesel fuels typically have a 90% point distillation temperature in the range of about 300° C. to about 390° C., and in one embodiment about 330° C. to about 350° C. The viscosity for these fuels typically ranges from about 1.3 to about 24 centistokes at 40° C. The diesel fuels can be classified as any of Grade Nos. 1-D, 2-D or 4-D as specified in ASTM D975. The diesel fuels may contain alcohols and esters. In one embodiment the diesel fuel has a sulfur content of up to about 0.05% by weight (low-sulfur diesel fuel) as determined by the test method specified in ASTM D2622-87. In one embodiment, the diesel fuel is a chlorine-free or low-chlorine diesel fuel characterized by chlorine content of no more than about 10 ppm.

The liquid hydrocarbon fuel is present in the aqueous hydrocarbon fuel emulsion at a concentration of about 50% to about 95% by weight, and in one embodiment about 60% to about 95% by weight, and in one embodiment about 65% to about 85% by weight, and in one embodiment about 70% to about 80% by weight.

The Water

The water used in forming the aqueous hydrocarbon fuel emulsions may be taken from any source. The water includes but is not limited to tap, deionized, demineralized, purified, for example, using reverse osmosis or distillation, and the like.

The water may be present in the aqueous hydrocarbon fuel emulsions at a concentration of about 1% to about 50% by weight, and in one embodiment about 5% to about 50% by weight, and in one embodiment about 5% to about 40% being weight, and in one embodiment about 5% to about 25% by weight, and in one embodiment about 10% to about 20% water.

The Emulsifier

The emulsifier is comprised of: (i) at least one fuel-soluble product made by reacting at least one hydrocarbyl-substituted carboxylic acid acylating agent with ammonia or an amine, the hydrocarbyl substituent of said acylating agent having about 50 to about 500 carbon atoms; (ii) at least one of an ionic or a nonionic compound having a hydrophilic-lipophilic balance (HLB) in one embodiment of about 1 to about 40; in one embodiment about 1 to about 30, in one embodiment about 1 to about 20, and in one embodiment about 1 to about 15; (iii) a mixture of (i) and (ii); or (iv) a water-soluble compound selected from the group consisting of amine salts, ammonium salts, azide compounds, nitro compounds, alkali metal salts, alkaline earth metal salts, and mixtures thereof in combination of with (i), (ii) or (iii). The emulsifier may be present in the water fuel emulsion at a concentration of about 0.05% to about 20% by weight, and in one embodiment about 0.05% to about 10% by weight, and in one embodiment about 0.1% to about 5% by weight, and in one embodiment about 0.1% to about 3% by weight.

The Fuel-Soluble Product (i)

The fuel-soluble product (i) may be at least one fuel-soluble product made by reacting at least one hydrocarbyl-substituted carboxylic acid acylating agent with ammonia or an amine, the hydrocarbyl substituent of said acylating agent having about 50 to about 500 carbon atoms.

The hydrocarbyl-substituted carboxylic acid acylating agents may be carboxylic acids or reactive equivalents of such acids. The reactive equivalents may be an acid halides, anhydrides, or esters, including partial esters and the like. The hydrocarbyl substituents for these carboxylic acid acylating agents may contain from about 50 to about 500 carbon atoms, and in one embodiment about 50 to about 300 carbon atoms, and in one embodiment about 60 to about 200 carbon atoms. In one embodiment, the hydrocarbyl substituents of these acylating agents have number average molecular weights of about 700 to about 3000, and in one embodiment about 900 to about 2300.

The hydrocarbyl-substituted carboxylic acid acylating agents may be made by reacting one or more alpha-beta olefinically unsaturated carboxylic acid reagents containing 2 to about 20 carbon atoms, exclusive of the carboxyl groups, with one or more olefin polymers as described more fully hereinafter.

The alpha-beta olefinically unsaturated carboxylic acid reagents may be either monobasic or polybasic in nature. Exemplary of the monobasic alpha-beta olefinically unsaturated carboxylic acid include the carboxylic acids corresponding to the formula

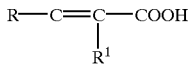

wherein R is hydrogen, or a saturated aliphatic or alicyclic, aryl, alkylaryl or heterocyclic group, preferably hydrogen or a lower alkyl group, and $R^1$ is hydrogen or a lower alkyl group. The total number of carbon atoms in R and $R^1$ typically does not exceed about 18 carbon atoms. Specific examples of useful monobasic alpha-beta olefinically unsaturated carboxylic acids include acrylic acid; methacrylic acid; cinnamic acid; crotonic acid; 3-phenyl propenoic acid; alpha, and beta-decenoic acid. The polybasic acid reagents are preferably dicarboxylic, although tri- and tetracarboxylic acids can be used. Exemplary polybasic acids include maleic acid, fumaric acid, mesaconic acid, itaconic acid and citraconic acid. Reactive equivalents of the alpha-beta olefinically unsaturated carboxylic acid reagents include the anhydride, ester or amide functional derivatives of the foregoing acids. A useful reactive equivalent is maleic anhydride.

The olefin monomers from which the olefin polymers may be derived are polymerizable olefin monomers characterized by having one or more ethylenic unsaturated groups. They may be monoolefinic monomers such as ethylene, propylene, 1-butene, isobutene and 1-octene or polyolefinic monomers (usually di-olefinic monomers such as 1,3-butadiene and isoprene). Usually these monomers are terminal olefins, that is, olefins characterized by the presence of the group>C═$CH_2$. However, certain internal olefins can also serve as monomers (these are sometimes referred to as medial olefins). When such medial olefin monomers are used, they normally are employed in combination with terminal olefins to produce olefin polymers that are interpolymers. Although, the olefin polymers may also include aromatic groups (especially phenyl groups and lower alkyl and/or lower alkoxy-substituted phenyl groups such as para (tertiary-butyl)-phenyl groups) and alicyclic groups such as would be obtained from polymerizable cyclic olefins or alicyclic-substituted polymerizable cyclic olefins, the olefin polymers are usually free from such groups. Nevertheless, olefin polymers derived from such interpolymers of both 1,3-dienes and styrenes such as 1,3-butadiene and styrene or para-(tertiary butyl) styrene are exceptions to this general rule. In one embodiment, the olefin polymer is a partially hydrogenated polymer derived from one or more dienes. Generally the olefin polymers are homo- or interpolymers of terminal hydrocarbyl olefins of about 2 to about 30 carbon atoms, and in one embodiment about 2 to about 16 carbon atoms. A more typical class of olefin polymers is selected from that group consisting of homo- and interpolymers of terminal olefins of 2 to about 6 carbon atoms, and in one embodiment 2 to about 4 carbon atoms.

Specific examples of terminal and medial olefin monomers which can be used to prepare the olefin polymers include ethylene, propylene, 1-butene, 2-butene, isobutene, 1-pentene, 1-hexene, 1-heptene, 1-octene, 1-nonene, 1-decene, 2-pentene, propylene tetramer, diisobutylene, isobutylene trimer, 1,2-butadiene, 1,3-butadiene, 1,2-pentadiene, 1,3-pentadiene, isoprene, 1,5-hexadiene, 2-chloro 1,3-butadiene, 2-methyl-1-heptene, 3-cyclohexyl-1 butene, 3,3-dimethyl 1-pentene, styrene, divinylbenzene, vinyl-acetate, allyl alcohol,1-methylvinylacetate, acrylonitrile, ethyl acrylate, ethylvinylether and methylvinylketone. Of these, the purely hydrocarbon monomers are more typical and the terminal olefin monomers are especially useful.

In one embodiment, the olefin polymers are polyisobutenes such as those obtained by polymerization of a $C_4$ refinery stream having a butene content of about 35 to about 75% by weight and an isobutene content of about 30 to about 60% by weight in the presence of a Lewis acid catalyst such as aluminum chloride or boron trifluoride. These polyisobutenes generally contain predominantly (that is, greater than about 50% of the total repeat units) isobutene repeat units of the configuration

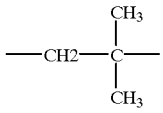

In one embodiment, the olefin polymer is a polyisobutene group (or polyisobutylene group) having a number average molecular weight of about 700 to about 3000, and in one embodiment about 900 to about 2300.

In one embodiment, the hydrocarbyl-substituted carboxylic acid acylating agent is a hydrocarbyl-substituted succinic acid or anhydride represented correspondingly by the formulae

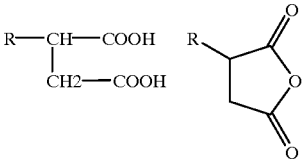

wherein R is hydrocarbyl group of about 50 to about 500 carbon atoms, and in one embodiment from about 50 to about 300, and in one embodiment from about 60 to about 200 carbon atoms. The production of these hydrocarbyl-substituted succinic acids or anhydrides via alkylation of maleic acid or anhydride or its derivatives with a halohydrocarbon or via reaction of maleic acid or anhydride with an olefin polymer having a terminal double bond is well known to those of skill in the art and need not be discussed in detail herein.

The hydrocarbyl-substituted carboxylic acid acylating agent may be a hydrocarbyl-substituted succinic acylating agent consisting of hydrocarbyl substituent groups and succinic groups. The hydrocarbyl substituent groups are derived from olefin polymers as discussed above. In one embodiment, the hydrocarbyl-substituted carboxylic acid acylating agent is characterized by the presence within its structure of an average of at least 1.3 succinic groups, and in one embodiment from about 1.3 to about 2.5, and in one embodiment about 1.5 to about 2.5, and in one embodiment from about 1.7 to about 2.1 succinic groups for each equivalent weight of the hydrocarbyl substituent. In one embodiment, the hydrocarbyl-substituted carboxylic acid acylating agent is characterized by the presence within its structure of about 1.0 to about 1.3, and in one embodiment about 1.0 to about 1.2, and in one embodiment from about 1.0 to about 1.1 succinic groups for each equivalent weight of the hydrocarbyl substituent.

In one embodiment, the hydrocarbyl-substituted carboxylic acid acylating agent is a polyisobutene-substituted succinic anhydride, the polyisobutene substituent having a number average molecular weight of about 1500 to about 3000, and in one embodiment about 1800 to about 2300, said first polyisobutene-substituted succinic anhydride being characterized by about 1.3 to about 2.5, and in one embodiment about 1.7 to about 2.1 succinic groups per equivalent weight of the polyisobutene substituent.

In one embodiment, the hydrocarbyl-substituted carboxylic acid acylating agent is a polyisobutene-substituted succinic anhydride, the polyisobutene substituent having a number average molecular weight of about 700 to about 1300, and in one embodiment about 800 to about 1000, said polyisobutene-substituted succinic anhydride being characterized by about 1.0 to about 1.3, and in one embodiment about 1.0 to about 1.2 succinic groups per equivalent weight of the polyisobutene substituent.

For purposes of this invention, the equivalent weight of the hydrocarbyl substituent group of the hydrocarbyl-substituted succinic acylating agent is deemed to be the number obtained by dividing the number average molecular weight ($M_n$) of the polyolefin from which the hydrocarbyl substituent is derived into the total weight of all the hydrocarbyl substituent groups present in the hydrocarbyl-substituted succinic acylating agents. Thus, if a hydrocarbyl-substituted acylating agent is characterized by a total weight of all hydrocarbyl substituents of 40,000 and the $M_n$ value for the polyolefin from which the hydrocarbyl substituent groups are derived is 2000, then that substituted succinic acylating agent is characterized by a total of 20 (40,000/2000=20) equivalent weights of substituent groups.

The ratio of succinic groups to equivalent of substituent groups present in the hydrocarbyl-substituted succinic acylating agent (also called the "succination ratio") can be determined by one skilled in the art using conventional techniques (such as from saponification or acid numbers). For example, the formula below can be used to calculate the succination ratio where maleic anhydride is used in the acylation process:

$$SR = \frac{M_n \times (\text{Sap. No. of acylating agent})}{(56100 \times 2) - (98 \times \text{Sap. No. of acylating agent})}$$

In this equation, SR is the succination ratio, $M_n$ is the number average molecular weight, and Sap. No. is the saponification number. In the above equation, Sap. No. of acylating agent=measured Sap. No. of the final reaction mixture/AI wherein AI is the active ingredient content expressed as a number between 0 and 1, but not equal to zero. Thus an active ingredient content of 80% corresponds to an AI value of 0.8. The Al value can be calculated by using techniques such as column chromatography, which can be used to determine the amount of unreacted polyalkene in the final reaction mixture. As a rough approximation, the value of AI is determined after subtracting the percentage of unreacted polyalkene from 100 and divide by 100.

The fuel-soluble product (i) may be formed using ammonia and/or an amine. The amines useful for reacting with the acylating agent to form the product (i) include monoamines, polyamines, and mixtures thereof.

The monoamines have only one amine functionality whereas the polyamines have two or more. The amines may be primary, secondary or tertiary amines. The primary amines are characterized by the presence of at least one —$NH_2$ group; the secondary by the presence of at least one H—N< group. The tertiary amines are analogous to the primary and secondary amines with the exception that the hydrogen atoms in the —$NH_2$ or H—N< groups are replaced by hydrocarbyl groups. Examples of primary and secondary monoamines include ethylamine, diethylamine, n-butylamine, di-n-butylamine, allylamine, isobutylamine, cocoamine, stearylamine, laurylamine, methyllaurylamine, oleylamine, N-methyloctylamine, dodecylamine, and octadecylamine. Suitable examples of tertiary monoamines include trimethylamine, triethylamine, tripropylamine, tributylamine, monomethyldimethylarnine, monoethyldimethylamine, dimethylpropylamine, dimethylbutylamine, dimethylpentylamine, dimethylhexylamine, dimethylheptylamine, and dimethyloctylamine.

The amine may be a hydroxyamine. The hydroxyamine may be a primary, secondary or tertiary amine. Typically, the hydroxamines are primary, secondary or tertiary alkanol amines.

The alkanol amines may be represented by the formulae:

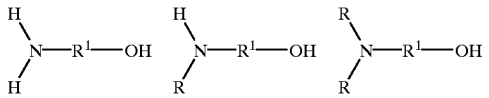

wherein in the above formulae each R is independently a hydrocarbyl group of 1 to about 8 carbon atoms, or a hydroxy-substituted hydrocarbyl group of 2 to about 8 carbon atoms and each R' independently is a hydrocarbylene (i.e., a divalent hydrocarbon) group of 2 to about 18 carbon atoms. The group —R'—OH in such formulae represents the hydroxy-substituted hydrocarbylene group. R' may be an acyclic, alicyclic, or aromatic group. In one embodiment, R' is an acyclic straight or branched alkylene group such as ethylene, 1,2-propylene, 1,2-butylene, 1,2-octadecylene, etc. group. When two R groups are present in the same molecule they may be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxy lower alkyl)-morpholines, -thiomorpholines, -piperidines, -oxazolidines, -thiazolidines and the like. Typically, however, each R is independently a lower alkyl group of up to seven carbon atoms.

Suitable examples of the above hydroxyamines include mono-, di-, and triethanolamine, dimethylethanol amine, diethylethanol amine, di-(3-hydroxy propyl) amine, N-(3-hydroxybutyl) amine, N-(4-hydroxy butyl) amine, and N,N-di-(2-hydroxypropyl) amine.

The amine may be an alkylene polyamine. Especially useful are the alkylene polyamines represented by the formula

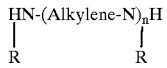

wherein n has an average value between 1 and about 10, and in one embodiment about 2 to about 7, the "Alkylene" group has from 1 to about 10 carbon atoms, and in one embodiment about 2 to about 6 carbon atoms, and each R is independently hydrogen, an aliphatic or hydroxy-substituted aliphatic group of up to about 30 carbon atoms. These alkylene polyamines include methylene polyamines, ethylene polyamines, butylene polyamines, propylene polyamines, pentylene polyamines, etc. Specific examples of such polyamines include ethylene diamine, diethylene triamine, triethylene tetramine, propylene diamine, trimethylene diarnine, tripropylene tetramine, tetraethylene pentamine, hexaethylene heptamine, pentaethylene hexamine, or a mixture of two or more thereof.

Ethylene polyamines are useful. These are described in detail under the heading Ethylene Amines in Kirk Othmer's "Encyclopedia of Chemical Technology", 2d Edition, Vol. 7, pages 22–37, Interscience Publishers, New York (1965). These polyamines may be prepared by the reaction of ethylene dichloride with ammonia or by reaction of an ethylene imine with a ring opening reagent such as water, ammonia, etc. These reactions result in the production of a complex mixture of polyalkylene polyamines including cyclic condensation products such as piperazines.

In one embodiment, the amine is a polyamine bottoms or a heavy polyamine. The term "polyamine bottoms" refers to those polyamines resulting from the stripping of a polyamine mixture to remove lower molecular weight polyamines and volatile components to leave, as residue, the polyamine bottoms. In one embodiment, the polyamine bottoms are characterized as having less than about 2% by weight total diethylene triamine or triethylene tetramine. A useful polyamine bottoms is available from Dow Chemical under the trade designation E-100. This material is described as having a specific gravity at 15.6°C of 1.0168, a nitrogen content of 33.15% by weight, and a viscosity at 40°C. of 121 centistokes. Another polyarnine bottoms that may be used is commercially available from Union Carbide under the trade designation HPA-X. This polyamine bottoms product contains cyclic condensation products such as piperazine and higher analogs of diethylene triamine, triethylene tetramine, and the like.

The term "heavy polyamine" refers to polyamines that contain seven or more nitrogen atoms per molecule, or polyamine oligomers containing seven or more nitrogens per molecule, and two or more primary amines per molecule. These are described in European Patent No. EP 0770098, which is incorporated herein by reference for its disclosure of such heavy polyamines.

The fuel-soluble product (i) may be a salt, an ester, an ester/salt, an amide, an imide, or a combination of two or more thereof. The salt may be an internal salt involving residues of a molecule of the acylating agent and the ammonia or amine wherein one of the carboxyl groups becomes ionically bound to a nitrogen atom within the same group; or it may be an external salt wherein the ionic salt group is formed with a nitrogen atom that is not part of the same molecule. In one embodiment, the amine is a hydroxyarnine, the hydrocarbyl-substituted carboxylic acid acylating agent is a hydrocarbyl-substituted succinic anhydride, and the resulting fuel-soluble product is a half ester and half salt, i.e., an ester/salt. In one embodiment, the amine is an alkylene polyarnine, the hydrocarbyl-substituted carboxylic acid acylating agent is a hydrocarbyl-substituted succinic anhydride, and the resulting fuel-soluble product is a succinimide.

The reaction between the hydrocarbyl-substituted carboxylic acid acylating agent and the ammonia or amine is carried out under conditions that provide for the formation of the desired product. Typically, the hydrocarbyl-substituted carboxylic acid acylating agent and the ammonia or amine are mixed together and heated to a temperature in the range of from about 50° C. to about 250° C., and in one embodiment from about 80° C. to about 200° C.; optionally in the presence of a normally liquid, substantially inert organic liquid solvent/diluent, until the desired product has formed. In one embodiment, the hydrocarbyl-substituted carboxylic acid acylating agent and the ammonia or amine are reacted in amounts sufficient to provide from about 0.3 to about 3 equivalents of hydrocarbyl-substituted carboxylic acid acylating agent per equivalent of ammonia or amine. In one embodiment, this ratio is from about 0.5:1 to about 2: 1, and in one embodiment about 1:1.

In one embodiment, the fuel soluble product (i) comprises: (i)(a) a first fuel-soluble product made by reacting a first hydrocarbyl-substituted carboxylic acid acylating agent with ammonia or an amine, the hydrocarbyl substituent of said first acylating agent having about 50 to about 500 carbon atoms; and (i)(b) a second fuel-soluble product made by reacting a second hydrocarbyl-substituted carboxylic acid acylating agent with ammonia or an amine, the hydrocarbyl substituent of said second acylating agent having about 50 to about 500 carbon atoms. In this embodiment, the products (i)(a) and (i)(b) are different. For example, the molecular weight of the hydrocarbyl substituent for the first acylating agent may be different than the molecular weight of the hydrocarbyl substituent for the second acylating agent. In one embodiment, the number average molecular weight for the hydrocarbyl substituent for the first acylating agent may be in the range of about 1500 to about 3000, and in one embodiment about 1800 to about 2300, and the number average molecular weight for the hydrocarbyl substituent for the second acylating agent may be in the range of about 700 to about 1300, and in one embodiment about 800 to about 1000. The first hydrocarbyl-substituted carboxylic acid acylating agent may be a polyisobutene-substituted succinic anhydride, the polyisobutene substituent having a number average molecular weight of about 1500 to about 3000, and in one embodiment about 1800 to about 2300. This first polyisobutene-substituted succinic anhydride may be characterized by at least about 1.3, and in one embodiment about 1.3 to about 2.5, and in one embodiment about 1.7 to about 2.1 succinic groups per equivalent weight of the polyisobutene substituent. The amine used in this first fuel-soluble product (i)(a) may be an alkanol amine and the product may be in the form of an ester/salt. The second hydrocarbyl-substituted carboxylic acid acylating agent may be a polyisobutene-substituted succinic anhydride, the polyisobutene substituent of said second polyisobutene-substituted succinic anhydride having a number average molecular weight of about 700 to about 1300, and in one embodiment about 800 to about 1000. This second polyisobutene-substituted succinic anhydride may be characterized by about 1.0 to about 1.3, and in one embodiment about 1.0 to about 1.2 succinic groups per equivalent weight of the polyisobutene substituent. The amine used in this second fuel-soluble product (i)(b) may be an alkanol amine and the product may be in the form of an ester/salt, or the amine may be an alkylene polyamine and the product may be in the form of a succinimide. The fuel-soluble product (i) may be comprised of: about 1% to about 99% by weight, and in one embodiment about 30% to about 70% by weight of the product (i)(a); and about 99% to about 1% by weight, and in one embodiment about 70% to about 30% by weight of the product (i)(b).

In one embodiment, the fuel soluble product (i) comprises: (i)(a) a first hydrocarbyl-substituted carboxylic acid acylating agent, the hydrocarbyl substituent of said first acylating agent having about 50 to about 500 carbon atoms; and (i)(b) a second hydrocarbyl-substituted carboxylic acid acylating agent, the hydrocarbyl substituent of said second acylating agent having about 50 to about 500 carbon atoms, said first acylating agent and said second acylating agent being the same or different; said first acylating agent and said second acylating agent being coupled together by a linking group derived from a compound having two or more primary amino groups, two or more secondary amino groups, at least one primary amino group and at least one secondary amino group, at least two hydroxyl groups, or at least one primary or secondary amino group and at least one hydroxyl group; said coupled acylating agents being reacted with ammonia or an amine. The molecular weight of the hydrocarbyl substituent for the first acylating agent may be the same as or it may be different than the molecular weight of the hydrocarbyl substituent for the second acylating agent. In one embodiment, the number average molecular weight for the hydrocarbyl substituent for the first and/or second acylating agent is in the range of about 1500 to about 3000, and in one embodiment about 1 800 to about 2300. In one embodiment, the number average molecular weight for the hydrocarbyl substituent for the first and/or second acylating agent is in the range of about 700 to about 1300, and in one embodiment about 800 to about 1000. The first and/or second hydrocarbyl-substituted carboxylic acid acylating agent may be a polyisobutene-substituted succinic anhydride, the polyisobutene substituent having a number average molecular weight of about 1500 to about 3000, and in one embodiment about 1800 to about 2300. This first and/or second polyisobutene-substituted succinic anhydride may be characterized by at least about 1.3, and in one embodiment about 1.3 to about 2.5, and in one embodiment about 1.7 to about 2.1 succinic groups per equivalent weight of the polyisobutene substituent. The first and/or second hydrocarbyl-substituted carboxylic acid acylating agent may be a polyisobutene-substituted succinic anhydride, the polyisobutene substituent having a number average molecular weight of about 700 to about 1300, and in one embodiment about 800 to about 1000. This first and/or second polyisobutene-substituted succinic anhydride may be characterized by about 1.0 to about 1.3, and in one embodiment about 1.0 to about 1.2 succinic groups per equivalent weight of the polyisobutene substituent. The linking group may be derived from any of the amines or hydroxamines discussed above having two or more primary amino groups, two or more secondary amino groups, at least one primary amino group and at least one secondary amino group, or at least one primary or secondary amino group and at least one hydroxyl group. The linking group may also be derived from a polyol. The polyol may be a compound represented by the formula $$R—(OH)_m$$

wherein in the foregoing formula, R is an organic group having a valency of m, R is joined to the OH groups through carbon-to-oxygen bonds, and m is an integer from 2 to about 10, and in one embodiment 2 to about 6. The polyol may be a glycol. The alkylene glycols are useful. Examples of the polyols that may be used include ethylene glycol, diethylene glycol, triethylene glycol, tetraethylene glycol, propylene glycol, dipropylene glycol, tripropylene glycol, dibutylene glycol, tributylene glycol, 1,2-butanediol, 2,3-dimethyl-2,3-butanediol, 2,3-hexanediol, 1,2-cyclohexanediol, pentaerythritol, dipentaerythritol, 1,7-heptanediol, 2,4-heptanediol, 1,2,3-hexanetriol, 1,2,4-hexanetriol, 1,2,5-hexanetriol, 2,3,4-hexanetriol, 1,2,3-butanetriol, 1,2,4-butanetriol, 2,2,66-tetrakis-(hydroxymethyl) cyclohexanol, 1,10-decanediol, digitalose, 2-hydroxymethyl-2-methyl-1, 3- propanediol (trimethylolethane), or 2-hydroxymethyl-2-ethyl-1,3-propanediol (trimethylopropane), and the like. Mixtures of two or more of the foregoing can be used.

The ratio of reactants utilized in the preparation of these linked products may be varied over a wide range. Generally, for each equivalent of each of the first and second acylating agents, at least about one equivalent of the linking compound is used. The upper limit of linking compound is about two equivalents of linking compound for each equivalent of the first and second acylating agents. Generally the ratio of equivalents of the first acylating agent to the second acylating agent is about 4:1 to about 1:4, and in one embodiment about 1.5:1.

The number of equivalents for the first and second acylating agents is dependent on the total number of carboxylic functions present in each. In determining the number of equivalents for each of the acylating agents, those carboxyl functions that are not capable of reacting as a carboxylic acid acylating agent are excluded. In general, however, there is one equivalent of each acylating agent for each carboxy group in the acylating agents. For example, there would be two equivalents in an anhydride derived from the reaction of one mole of olefin polymer and one mole of maleic anhydride.

The weight of an equivalent of a polyamine is the molecular weight of the polyamine divided by the total number of nitrogens present in the molecule. When the polyamine is to be used as linking compound, tertiary amino groups are not counted. The weight of an equivalent of a commercially available mixture of polyamines can be determined by dividing the atomic weight of nitrogen (14) by the % N contained in the polyamine; thus, a polyamine mixture having a % N of 34 would have an equivalent weight of 41.2. The weight of an equivalent of ammonia or a monoamine is equal to its molecular weight.

The weight of an equivalent of a polyol is its molecular weight divided by the total number of hydroxyl groups present in the molecule. Thus, the weight of an equivalent of ethylene glycol is one-half its molecular weight.

The weight of an equivalent of a hydroxyamine that is to be used as a linking compound is equal to its molecular weight divided by the total number of —OH, >NH and —$NH_2$ groups present in the molecule.

The first and second acylating agents may be reacted with the linking compound according to conventional ester and/or amide-forming techniques. This normally involves heating acylating agents with the linking compound, optionally in the presence of a normally liquid, substantially inert, organic liquid solvent/diluent. Temperatures of at least about 30° C. up to the decomposition temperature of the reaction component and/or product having the lowest such temperature can be used. This temperature may be in the range of about 50° C. to about 130° C., and in one embodiment about 80° C. to about 100° C. when the acylating agents are anhydrides. On the other hand, when the acylating agents are acids, this temperature may be in the range of about 100° C. to about 300° C. with temperatures in the range of about 125° C. to about 250° C. often being employed.

The linked product made by this reaction may be in the form of statistical mixture that is dependent on the charge of each of the acylating agents, and on the number of reactive sites on the linking compound. For example, if an equal molar ratio of the first and second acylating agents is reacted with ethylene glycol, the product would be comprised of a mixture of (1) about 50% of compounds wherein one molecule the first acylating agent is linked to one molecule of the second acylating agent through the ethylene glycol; (2) about 25% of compounds wherein two molecules of the first acylating agent are linked together through the ethylene glycol; and (3) about 25% of compounds wherein two molecules of the second acylating agent are linked together through the ethylene glycol.

The reaction between the linked acylating agents and the ammonia or amine may be carried out under salt, ester/salt, amide or imide forming conditions using conventional techniques. Typically, these components are mixed together and heated to a temperature in the range of about 20□C up to the decomposition temperature of the reaction component and/or product having the lowest such temperature, and in one embodiment about 50° C. to about 130° C., and in one embodiment about 80° C. to about 110° C.; optionally, in the presence of a normally liquid, substantially inert organic liquid solvent/diluent, until the desired salt product has formed.

The following examples are provided to illustrate the preparation of the fuel-soluble products (i) discussed above.

EXAMPLE 2

A twelve-liter, four-neck flask is charged with Adibis ADX 101G (7513 grams). Adibis ADX 101G, which is a product available from Lubrizol Adibis, is comprised of a polyisobutene-substituted succinic anhydride mixture wherein 60% by weight is a first polyisobutene-substituted succinic anhydride wherein the polyisobutene substituent has a number average molecular weight of 2300 and is derived from a polyisobutene having methylvinylidene isomer content of 80% by weight, and 40% by weight is a second polyisobutene-substituted succinic anhydride wherein the polyisobutene substituent has a number average molecular weight of 1000 and is derived from a polyisobutene having methylvinylidene isomer content of 85% by weight.

The product has a diluent oil content of 30% by weight and a succination ratio of 1.4 (after correcting for unreacted polyisobutene). The flask is equipped with an overhead stirrer, a thermocouple, an addition funnel topped with an $N_2$ inlet, and a condenser. The succinic anhydride mixture is stirred and heated at 95° C., and ethylene glycol (137 grams) is added via the addition funnel over five minutes. The resulting mixture is stirred and maintained at 102–107° C. for 4 hours. Dimethylethanol amine (392 grams) is charged to the mixture over 30 minutes such that the reaction temperature does not exceed 107° C. The mixture is maintained at 100–105° C. for 2 hours, and filtered to provide a brown, viscous product.

EXAMPLE 3

A three-liter, four-neck flask is charged with Adibis ADX 101G (1410 grams). The flask is equipped with an overhead stirrer, a thermocouple, an addition funnel topped with an $N_2$ inlet, and a condenser. The succinic anhydride mixture is stirred and heated to 61° C. Ethylene glycol (26.3 grams) is added via the addition funnel over five minutes. The resulting mixture is stirred and heated to 105–110° C. and maintained at that temperature for 4.5 hours. The mixture is cooled to 96° C., and dimethylaminoethanol (77.1 grams) is charged to the mixture over 5 minutes such that the reaction temperature does not exceed 100° C. The mixture is maintained at 95° C. for 1 hour, and then at 160° C. for 4 hours. The product is a brown, viscous product.

The fuel-soluble product (i) may be present in the water-fuel emulsion at a concentration of up to about 15% by weight based on the overall weight of the emulsion, and in one embodiment about 0.1 to about 15% by weight, and an one embodiment about 0.1 to about 10% by weight, and in one embodiment about 0.1 to about 5% by weight, and in one embodiment about 0.1 to about 2% by weight, and in one embodiment about 0.1 to about 1% by weight, and in one embodiment about 0.1 to about 0.7% by weight.

The Ionic or Nonionic Compound (ii)

The ionic or nonionic compound (ii) has a hydrophilic-lipophilic balance (HLB, which refers to the size and strength of the polar (hydrophilic) and non-polar (lipophilic) groups on the surfactant molecule) in the range of about 1 to about 40, and in one embodiment about 4 to about 15. Examples of these compounds are disclosed in *McCutcheon's Emulsifiers and Detergents,* 1998, North American & International Edition. Pages 1–235 of the North American Edition and pages 1–199 of the International Edition are incorporated herein by reference for their disclosure of such ionic and nonionic compounds having an HLB in the range of about 1 to about 40, in one embodiment about 1 to about 30, in one embodiment about 1 to 20, and in another embodiment about 1 to about 10. Useful compounds include alkanolamides, alkylarylsulfonates, amine oxides, poly (oxyalkylene) compounds, including block copolymers comprising alkylene oxide repeat units, carboxylated alcohol ethoxylates, ethoxylated alcohols, ethoxylated alkyl phenols, ethoxylated amines and amides, ethoxylated fatty acids, ethoxylated fatty esters and oils, fatty esters, fatty acid amides, glycerol esters, glycol esters, sorbitan esters, imidazoline derivatives, lecithin and derivatives, lignin and derivatives, monoglycerides and derivatives, olefin sulfonates, phosphate esters and derivatives, propoxylated and ethoxylated fatty acids or alcohols or alkyl phenols, sorbitan derivatives, sucrose esters and derivatives, sulfates or alcohols or ethoxylated alcohols or fatty esters, sulfonates of dodecyl and tridecyl benzenes or condensed naphthalenes or petroleum, sulfosuccinates and derivatives, and tridecyl and dodecyl benzene sulfonic acids.

In one embodiment, the ionic or nonionic compound (ii) is a fuel-soluble product made by reacting an acylating agent having about 12 to about 30 carbon atoms with ammonia or an amine. The acylating agent may contain about 12 to about 24 carbon atoms, and in one embodiment about 12 to about 18 carbon atoms. The acylating agent may be a carboxylic acid or a reactive equivalent thereof. The reactive equivalents include acid halides, anhydrides, esters, and the like. These acylating agents may be monobasic acids or polybasic acids. The polybasic acids are preferably dicarboxylic, although tri- and tetra-carboxylic acids may be used. These acylating agents may be fatty acids. Examples include myristic acid, palmitic acid, stearic acid, oleic acid, linoleic acid, linolenic acid, and the like. These acylating agents may be succinic acids or anhydrides represented, respectively, by the formulae

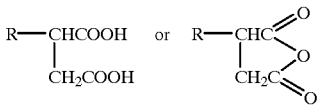

wherein each of the foregoing formulae R is a hydrocarbyl group of about 10 to about 28 carbon atoms, and in one embodiment about 12 to about 20 carbon atoms. Examples include tetrapropylene-substituted succinic acid or anhydride, hexadecyl succinic acid or anhydride, and the like. The amine may be any of the amines described above as being useful in making the fuel-soluble product (i). The product of the reaction between the acylating agent and the ammonia or amine may be a salt, an ester, an amide, an amide, or a combination thereof. The salt may be an internal salt involving residues of a molecule of the acylating agent and the ammonia or amine wherein one of the carboxyl groups becomes ionically bound to a nitrogen atom within the same group; or it may be an external salt wherein the ionic salt group is formed with a nitrogen atom that is not part of the same molecule. The reaction between the acylating agent and the ammonia or amine is carried out under conditions that provide for the formation of the desired product. Typically, the acylating agent and the ammonia or amine are mixed together and heated to a temperature in the range of from about 50° C. to about 250° C., and in one embodiment from about 80° C. to about 200° C.; optionally in the presence of a normally liquid, substantially inert organic liquid solvent/diluent, until the desired product has formed. In one embodiment, the acylating agent and the ammonia or amine are reacted in amounts sufficient to provide from about 0.3 to about 3 equivalents of acylating agent per equivalent of ammonia or amine. In one embodiment, this ratio is from about 0.5:1 to about 2:1, and in one embodiment about 1:1.

In one embodiment, the ionic or nonionic compound (ii) is an ester/salt made by reacting hexadecyl succinic anhydride with dimethylethanol amine in an equivalent ratio (i.e., carbonyl to amine ratio) of about 1:1 to about 1:1.5, and in one embodiment about 1:1.35.

The ionic or nonionic compound (ii) may be present in the water fuel emulsion at a concentration of up to about 15% by weight, and in one embodiment about 0.01 to about 15% by weight, and in one embodiment about 0.01 to about 10% by weight, and one embodiment about 0.01 to about 5% by weight, and in one embodiment about 0.01 to about 3% by weight, and in one embodiment about 0.1 to about 1% by weight.

The Water-Soluble Compound

The water-soluble compound may be an amine salt, ammonium salt, azide compound, nitro compound, alkali metal salt, alkaline earth metal salt, or mixtures of two or more thereof. These compounds are distinct from the fuel-soluble product (i) and the ionic or nonionic compound (ii) discussed above. These water-soluble compounds include organic amine nitrates, nitrate esters, azides, nitramines and nitro compounds. Also included are alkali and alkaline earth metal carbonates, sulfates, sulfides, sulfonates, and the like.

Particularly useful are the amine or ammonium salts represented by the formula $$k[G(NR_3)_y]^{y+}nX^{p-}$$

wherein G is hydrogen or an organic group of 1 to about 8 carbon atoms, and in one embodiment 1 to about 2 carbon atoms, having a valence of y; each R independently is hydrogen or a hydrocarbyl group of 1 to about 10 carbon atoms, and in one embodiment 1 to about 5 carbon atoms, and in one embodiment 1 to about 2 carbon atoms; $X^{p-}$ is an anion having a valence of p; and k, y, n and p are independently integers of at least 1. When G is H, y is 1. The sum of the positive charge $ky^+$ is equal to the sum of the negative charge $nX^{p-}$. In one embodiment, X is a nitrate ion; and in one embodiment it is an acetate ion. Examples include ammonium nitrate, ammonium acetate, methylammonium nitrate, methylammonium acetate, ethylene diamine diacetate, urea nitrate, urea and guanidinium nitrate. Ammonium nitrate is particularly useful.

In one embodiment, the water-soluble compound functions as an emulsion stabilizer, i.e., it acts to stabilize the water-fuel emulsion. Thus, in one embodiment, the water-soluble compound is present in the water fuel emulsion in an emulsion stabilizing amount.

In one embodiment, the water-soluble compound functions as a combustion improver. A combustion improver is characterized by its ability to increase the mass burning rate of the fuel composition. The presence of such a combustion improver has the effect of improving the power output of an engine. Thus, in one embodiment, the water-soluble compound is present in the water-fuel emulsion in a combustion-improving amount.

The water-soluble compound may be present in the water-fuel emulsion at a concentration of about 0.001 to about 1% by weight, and in one embodiment from about 0.01 to about 1% by weight.

Cetane Improver

In one embodiment, the water-fuel emulsion contains a cetane improver. The cetane improvers that are useful include but are not limited to peroxides, nitrates, nitrites, nitrocarbamates, and the like. Useful cetane improvers include but are not limited to nitropropane, dinitropropane, tetranitromethane, 2-nitro-2-methyl-1-butanol, 2-methyl-2-nitro-1-propanol, and the like. Also included are nitrate esters of substituted or unsubstituted aliphatic or cycloaliphatic alcohols which may be monohydric or polyhydric. These include substituted and unsubstituted alkyl or cycloalkyl nitrates having up to about 10 carbon atoms, and in one embodiment about 2 to about 10 carbon atoms. The alkyl group may be either linear or branched, or a mixture of linear or branched alkyl groups. Examples include methyl nitrate, ethyl nitrate, n-propyl nitrate, isopropyl nitrate, allyl nitrate, n-butyl nitrate, isobutyl nitrate, sec-butyl nitrate, tert-butyl nitrate, n-amyl nitrate, isoamyl nitrate, 2-amyl nitrate, 3-amyl nitrate, tert-amyl nitrate, n-hexyl nitrate, n-heptyl nitrate, n-octyl nitrate, 2-ethylhexyl nitrate, sec-octyl nitrate, n-nonyl nitrate, n-decyl nitrate, cyclopentyl nitrate, cyclohexyl nitrate, methylcyclohexyl nitrate, and isopropylcyclohexyl nitrate. Also useful are the nitrate esters of alkoxy-substituted aliphatic alcohols such as 2-ethoxyethyl nitrate, 2-(2-ethoxy-ethoxy) ethyl nitrate, 1-methoxypropyl-2-nitrate, 4-ethoxybutyl nitrate, etc., as well as diol nitrates such as 1,6-hexamethylene dinitrate. A useful cetane improver is 2-ethylhexyl nitrate.

The concentration of the cetane improver in the water-fuel emulsion may be at any concentration sufficient to provide the emulsion with the desired cetane number. In one embodiment, the concentration of the cetane improver is at a level of up to about 10% by weight, and in one embodiment about 0.05 to about 10% by weight, and in one embodiment about 0.05 to about 5% by weight, and in one embodiment about 0.05 to about 1% by weight.

Additional Additives

In addition to the foregoing materials, other fuel additives that are well known to those of skill in the art may be used in the water-fuel emulsions of the invention. These include but are not limited to dyes, rust inhibitors such as alkylated succinic acids and anhydrides, bacteriostatic agents, gum inhibitors, metal deactivators, upper cylinder lubricants, and the like. These additional additives may be used at concentrations of up to about 1% by weight based on the total weight of the water-fuel emulsions, and in one embodiment about 0.01 to about 1% by weight.

The total concentration of chemical additives, including the foregoing emulsifiers, in the water-fuel emulsions of the invention may range from about 0.05 to about 30% by weight, and in one embodiment about 0.1 to about 20% by weight, and in one embodiment about 0.1 to about 15% by weight, and in one embodiment about 0.1 to about 10% by weight, and in one embodiment about 0.1 to about 5% by weight.

Organic Solvent

The additives, including the foregoing emulsifiers, may be diluted with a substantially inert, normally liquid organic solvent such as naphtha, benzene, toluene, xylene or diesel fuel to form an additive concentrate which is then mixed with the fuel and water to form the water-fuel emulsion. These concentrates (extrapolate) generally contain from about 10% to about 90% by weight of the foregoing solvent.

The water-fuel emulsions may contain up to about 60% by weight organic solvent, and in one embodiment about 0.01 to about 50% by weight, and in one embodiment about 0.01 to about 20% by weight, and in one embodiment about 0.1 to about 5% by weight, and in one embodiment about 0.1 to about 3% by weight.

Antifreeze Agent

In one embodiment, the water-fuel emulsions of the invention contain an antifreeze agent. The antifreeze agent is typically an alcohol. Examples include but are not limited to ethylene glycol, propylene glycol, methanol, ethanol, glycerol and mixtures of two or more thereof. The antifreeze agent is typically used at a concentration sufficient to prevent freezing of the water used in the water-fuel emulsions. The concentration is therefore dependent upon the temperature at which the fuel is stored or used. In one embodiment, the concentration is at a level of up to about 20% by weight based on the weight of the water-fuel emulsion, and in one embodiment about 0.1 to about 20% by weight, and in one embodiment about 1 to about 10% by weight.

EXAMPLE 4

This example provides an illustrative example of the water-diesel fuel emulsions of the invention. The numerical values indicated below are in parts by weight.

| Components | A | B |
|---|---|---|
| ULSD Diesel Fuel | 76.48 | 88.24 |
| Demineralized Water | 20.00 | 10.00 |
| Product of Example 2 | 0.890 | 0.445 |
| Emulsifier 1[1] | 0.232 | 0.116 |
| Organic Solvent[2] | 1.391 | 0.696 |
| 2-Ethylhexyl nitrate | 0.476 | 0.238 |
| Ammonium nitrate (54% by wt. $NH_4NO_3$ in water) | 0.532 | 0.266 |

[1]Ester/salt prepared by reacting a hexadecyl succinic anhydride with dimethylethanol amine at a mole ratio of 1:1.35.
[2]Aliphatic solvent.

The emulsion is prepared by mixing all of the ingredients in formulations A and B except for the water using conventional mixing. The resulting diesel fuel-chemical additives mixture is then mixed with the water under high-shear mixing conditions to provide the water-diesel fuel emulsion. The high-shear mixer is provided by Advanced Engineering Ltd. under Model No. ADIL 4S-30 and is identified as a four-stage multi-shear in-line mixer fitted with four super-fine dispersion heads and a double acting mechanical seal.

EXAMPLE 5

Additional formulations for the water-fuel emulsions are indicated below. The numerical values indicated below are in parts by weight. Emulsifier 1 indicated below is the same as indicated in Example 3. Emulsifier 2 is an ester/salt prepared by reacting polyisobutene-($M_n$=2000) substituted succinic anhydride (ratio of succinic groups to polyisobutene equivalent weights of 1.7) with dimethylethanol amine in an equivalent weight ratio of 1:1 (1 mole succinic anhydride acid group to 2 moles of amine). Emulsifier 3 is a succinimide derived from polyisobutene-(Mn=1000) substituted monosuccinic anhydride and an ethylene polyamine mixture consisting of approximately 80% by weight heavy polyamine and 20% by weight diethylene triamine. The Organic Solvent is an aromatic solvent.

| | C | D | E | F | G |
|---|---|---|---|---|---|
| Diesel Fuel | 78.68 | 78.80 | 78.78 | 78.12 | 78.78 |
| Deionized Water | 16.70 | 19.70 | 20.00 | 20.00 | 20.00 |
| Emulsifier 1 | 0.600 | — | 0.500 | 0.510 | 0.500 |
| Emulsifier 2 | | 0.600 | 0.083 | 0.214 | 0.083 |
| Emulsifier 3 | — | — | | 0.297 | — |
| Organic Solvent | 0.350 | 0.350 | 0.340 | — | 0.340 |
| 2-Ethylhexyl nitrate | 0.470 | 0.350 | 0.350 | 0.714 | 0.350 |
| Ammonium nitrate (54% by wt $NH_4NO_3$ in water) | 0.200 | 0.200 | — | 0.150 | 0.200 |
| Ammonium nitrate (50% by wt $NH_4NO_3$ in water) | — | — | 0.200 | — | — |
| Methanol | 3.00 | — | — | — | — |

EXAMPLE 6

| | H | I |
|---|---|---|
| Product of Example 2 | 34 | — |
| Product of Example 3 | — | 34 |
| Emulsifier 1 | 6 | 6 |
| Organic Solvent | 23.2 | 23.2 |
| 2-Ethylhexyl nitrate | 23.8 | 23.8 |
| Ammonium nitrate (54% by wt $NH_4NO_3$ in water) | 13 | 13 |

EXAMPLE 7

From the above description of examples and invention, those skilled in the art will perceive improvements, changes and modifications in the invention. Such improvements, changes and modifications are intended to be covered by the claims.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A process to produce an aqueous hydrocarbon fuel comprising:

(a) preparing a hydrocarbon fuel/additives mixture comprising 1) about 50% to about 99% by weight of a liquid hydrocarbon fuel and 2) about 0.05% to about 25% by weight of an emulsifier wherein the emulsifier is comprised of (i) at least one fuel-soluble product made by reacting at least one hydrocarbyl-substituted carboxylic acid acylating agent with ammonia or an amine, the hydrocarbyl-substituted acylating agent having about 50 to about 500 carbon atoms; (ii) at least one of an ionic or non-ionic compound having a hydrophilic-lipophilic balance of about 1 to about 40; (iii) a mixture of (i) and (ii); or (iv) a water-soluble compound selected from the group consisting of amine salts, ammonium salts, azide compounds, nitro compounds, nitrate esters, nitramine, alkali metal salts, alkaline earth metal salts, and mixtures thereof in combination with (i), (ii) or (iii); wherein the water soluble salt is about 0.001% to about 15% by weight of a water-soluble salt distinct from (i) and (ii) and represented by the formula $$k[G(NR_3)_y]^{y+}nX^{p-},$$

wherein G is hydrogen or an organic group of about 1 to about 8 carbon atoms having a valence of y; each R independently is hydrogen or a hydrocarbyl group of about 1 to about 10 carbon atoms; provided either G or at least one R is hydrogen; $X^{p-}$ is an anion having a valence of p, and k, y, n and p are independently integers of at least 1;

(b) emulsifying the hydrocarbon fuel and emulsifier with a water mixture selected from the group consisting of a water, water-antifreeze, water ammonium nitrate, water-antifreeze ammonium nitrate mixture or combinations thereof to form an aqueous hydrocarbon fuel/additive emulsion with a water particle size having a mean diameter of greater than 1 micron in a first emulsification device;

(c) directly transferring the aqueous hydrocarbon fuel/additive emulsion to a second emulsification device, (d) mixing the aqueous hydrocarbon fuel/additive emulsion at a rate to shear the emulsion to a particle size having a mean diameter of less than 1 micron in the second emulsification device;

(e) transferring the aqueous hydrocarbon fuel additive emulsion from step (d) to a storage tank; wherein the process is a continuous process.

2. The process of claim 1 wherein the emulsifier is comprised of (iv) a water-soluble compound selected from the group consisting of amine salts, ammonium salts, azide compounds, nitro compounds, nitrate esters, nitramine, alkali metal salts, alkaline earth metal salts, and mixtures thereof, in combination with (i), (ii) or (iii).

3. The process of claim 2 wherein the water-soluble compound is ammonium nitrate.

4. The process of claim 1 wherein the emulsifier is comprised of a mixture of (i) at least one fuel-soluble product made by reacting at least one hydrocarbyl-substituted carboxylic acid acylating agent with ammonia or an amine, the hydrocarbyl-substituted acylating agent having about 50 to about 500 carbon atoms; (ii) at least one of an ionic or non-ionic compound having a hydrophilic-lipophilic balance of about 1 to about 40, and a water-soluble compound selected from the group consisting of amine salts, ammonium salts, azide compounds, nitro compounds, nitrate esters, nitramine, alkali metal salts, alkaline earth metal salts, and mixtures thereof.

5. The process of claim 4 wherein the water-soluble compound is ammonium nitrate.

6. The process of claim 1 wherein the emulsifier (i) is a combination of (i)(a) at least one reaction product of an acylating agent with an alkanol amine and (i)(b) at least one reaction product of an acylating agent with at least one ethylene polyamine.

7. The process of claim 6 wherein at least one ethylene polyamine is selected from the group consisting of polyamine bottoms or at least one heavy polyamine.

8. The process of claim 1 wherein the hydrocarbon fuel/additive mixture comprises about 85% to about 99.9% by weight of a liquid hydrocarbon fuel and about 0.1% to about 15% of an emulsifier.

9. The process of claim 1 wherein the hydrocarbon fuel/additive mixture comprises about 95% to 98% by weight of a liquid hydrocarbon fuel and about 2% to about 5% of an emulsifier.

10. The process of claim 1 comprising adding an additive to the hydrocarbon fuel/additives mixture selected from the group consisting of cetane improvers, organic solvents, surfactants, other fuel additives and combinations thereof in the range of about 1% to about 40% by weight of an additive emulsifier mixture.

11. The process of claim 1 comprising combining the hydrocarbon fuel/additives mixture and the water prior to the first mixing device, in the first mixing device or combinations thereof.

12. The process of claim 1 wherein the hydrocarbon fuel/additives mixture flows at a rate in the range of about 0.5 gallons to about 1000 gallons per minute and the water mixture flows at a rate in the range of about of 0.5 gallons to about 1000 gallons.

13. The process of claim 1 wherein the hydrocarbon fuel/additives mixtures flows at a rate in the range of about of 10 gallons to about 600 gallons per minute and the water mixture flows at about a rate in the range of about 10 gallons to about 600 gallons.

14. The process of claim 1 wherein the ratio of hydrocarbon fuel/additives mixture to water is in the range of about 50 to about 99 to about 50 to about 1.

15. The process of claim 1 wherein the ratio of hydrocarbon fuel/additives mixture to water is in the range of about 85 to about 95 to about 15 to about 5.

16. The process of claim 1 wherein the ratio of hydrocarbon fuel/additives mixture to water is about 75 to about 85 to about 28 to about 15.

17. The process of claim 1 wherein there is no aging of the hydrocarbon fuel additive water emulsion between the first emulsification step and the second emulsification step.

18. The process of claim 1 wherein when the first emulsification results in an emulsion having a mean droplet size particle greater than about 1 micron.

19. The process of claim 1 wherein when the first emulsification results in an emulsion having a mean droplet particle size in the range of about 1 micron to about 1000 microns.

20. The process of claim 1 wherein the second emulsification results in an emulsion as having a mean droplet particle size in the range of about 0.01 micron to about 1 micron.

21. The process of claim 1 wherein the second emulsification results in an emulsion having a mean droplet particle size in the range of about 0.1 micron to about 1 micron.

22. An apparatus for continuously making a aqueous hydrocarbon fuel comprising:

(a) at least two emulsification devices in series; wherein there is no holding tank between the two emulsification devices;

(b) a tank containing a hydrocarbon fuel/additive mixture comprising about 50% to about 90% by weight liquid hydrocarbon fuel and about 0.05% to about 25% by weight of an emulsifier comprising (i) at least one fuel-soluble product made by reacting at least one hydrocarbyl-substituted carboxylic acid acylating agent with ammonia or an amine, the hydrocarbyl-substituted acylating agent having about 50 to about 500 carbon atoms; (ii) at least one of an ionic or non-ionic compound having a hydrophilic-lipophilic balance of about 1 to about 40; (iii) a mixture of (i) and (ii) or (iv) a water-soluble compound selected from the group consisting of amine salts, ammonium salts, azide compounds, nitro compounds, nitrate esters, nitramine, alkali metal salts, alkaline earth metal salts and mixtures thereof, in combinations with (i), (ii) or (iii) wherein the water soluble salt is about 0.001% to about 15% by weight of a water-soluble salt distinct from (i) and (ii) represented by the formula $$k[G(NR_3)_y]^{y+}nX^{p-},$$

wherein G is hydrogen or an organic group of about 1 to about 8 carbon atoms having a valence of y; each R independently is hydrogen or a hydrocarbyl group of about 1 to about 10 carbon atoms; provided either G or at least one R is hydrogen; $X^{p-}$ is an anion having a valence of p, and k, y, n and p are independently integers at least 1;

(c) a conduit for transferring the hydrocarbon fuel/additives mixture from the tank to a first emulsification device;

(d) a conduit for transferring water from a water source to the first emulsification device;

(e) a conduit for transferring the aqueous hydrocarbon fuel emulsion from the first emulsification device to a second emulsification device;

(f) a conduit for transferring the aqueous hydrocarbon fuel emulsion from the second emulsification device to a fuel storage tank or object being fueled; and (h) a programmable logic controller for automatically controlling the continuous process; wherein the aqueous hydrocarbon fuel emulsion has a mean droplet particle size of less than 1 micron.

23. The apparatus of claim 22 comprising a conduit for dispensing the aqueous hydrocarbon fuel emulsion from the fuel storage tank.

24. The apparatus of claim 22 wherein the first emulsification device is selected from a group consisting of shear mixers, mechanical mixers, agitator, stir tank, static mixers, sonic mixers, pipeline static mixers, hydraulic shear mixers, rotational shears mixers, aquashear mixers, high-pressure homogenizer, and combinations thereof.

25. The apparatus of claim 22 wherein the second emulsification device is selected from the group consisting of high shear mixers selected from the group consisting of aquashear mixers, pipeline static mixers, hydraulic shear devices, rotational shear mixers, ultrasonic mixing, and combinations thereof.

* * * * *